US006626522B2

(12) United States Patent
Rapp et al.

(10) Patent No.: US 6,626,522 B2
(45) Date of Patent: Sep. 30, 2003

(54) FILTERING TECHNIQUES FOR PRINTHEAD INTERNAL CONTAMINATION

(75) Inventors: Gerald V. Rapp, Escondido, CA (US); Noah C. Lassar, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/952,164

(22) Filed: Sep. 11, 2001

(65) Prior Publication Data

US 2003/0048333 A1 Mar. 13, 2003

(51) Int. Cl.[7] ..... B41J 2/05; B41J 2/175; B41J 2/17

(52) U.S. Cl. ..... 347/65; 347/93; 347/94

(58) Field of Search ..... 347/63, 65, 93, 347/94, 92, 67, 56, 91

(56) References Cited

U.S. PATENT DOCUMENTS 5,463,413 A * 10/1995 Ho et al. ..... 347/65
5,734,399 A 3/1998 Weber et al. ..... 347/65
6,162,589 A 12/2000 Chen et al. ..... 430/320

FOREIGN PATENT DOCUMENTS

EP 0314486 A2 3/1989 ..... B41J/3/04

* cited by examiner

*Primary Examiner*—Craig Hallacher
*Assistant Examiner*—Juanita Stephens

(57) ABSTRACT

Techniques are described for constructing filter type features capable of entrapping particle contaminants to eliminate printing defects. These techniques utilize photo-imageable barrier material to fabricate various shapes and forms to reduce feature sizes. Several of these techniques utilize barrier material of height less than barrier materials used to fabricate ink feed channels and firing chamber walls. Another variation describes creation of a filter mesh from two layers of reduced height barrier materials.

22 Claims, 6 Drawing Sheets

FILTERING TECHNIQUES FOR PRINTHEAD INTERNAL CONTAMINATION

TECHNICAL FIELD OF THE DISCLOSURE

This invention relates to inkjet printheads, and more particularly to techniques for addressing internal contamination problems in printheads.

BACKGROUND OF THE DISCLOSURE

Inkjet pens include a printhead comprising a plurality of orifices from which ink is expelled toward a print medium such as paper. Some pens include a reservoir of ink; others are connected to an ink supply through a fluid interconnect. A plurality of ink passageways exist between the ink reservoir and a plurality of firing chambers. Each such firing chamber includes a resistive heating element which is energized upon demand to expel an ink droplet through a nozzle orifice associated with that resistive heating element. The orifices are located on a surface such that the expulsion of ink droplets out of a determined number of orifices relative to a particular position of the medium results in the production of a portion of a desired character or image. Controlled positioning of the printhead and/or print medium with further expulsions of ink droplets continues the production of more pixels of the desired character or image.

The channels through which ink flows and orifices through which the ink is expelled are continually reducing in size with technology improvements. This leads to a need for improved filtering capability to prevent blockage by small particles or impurities within the ink and/or particle contaminants resident on the inside surfaces of printhead materials after manufacture. Some current inkjet pens utilize fine mesh filters to separate particle contaminants carried in the bulk ink before it reaches the firing chambers. With a move to smaller fluidic flow pathway geometries within the printhead, a reduction in the filter mesh size for filtration capability has to be balanced with overall filter area so that the filter does not inhibit inkflow during high-speed full saturation printing. Increasing filter area can cause printhead size to increase, a detriment to printer design and cost.

The next line of defense after the filter are barrier features that are meant to trap particles just before they reach the firing chamber and nozzle. Previous solutions consisted of full height barrier features that spanned from the silicon substrate up the Kapton (TM) nozzle plate like columns. These columns were often located along the edge of the die like reef islands. The recommended minimum spacing between these columns was 15 $\mu$m so that channels between adjacent barrier features could be adequately cleared during the photoimaging and etching processes. In addition, the recommended minimum barrier column diameter was 20 $\mu$m to provide adequate adhesion between the barrier and the substrate and to prevent shortening of the barrier columns. With tighter nozzle spacing, large barrier islands spaced close together to trap small particles prevented adequate ink flow for high throughput images.

The minimum dimension between columns and the minimum column diameter worked well to trap contaminants in printheads whose nozzle diameters were larger than the minimum column barrier spacing because particles that passed through the barrier would simply be ejected out the nozzles. However, as nozzle diameters reduced in size smaller than the recommended barrier spacings and sizes, very small particles that pass through the barrier reef islands are trapped in the firing chamber/nozzle bore.

SUMMARY OF THE DISCLOSURE

Techniques are described for constructing filter type features capable of entrapping particle contaminants to eliminate printing defects. These designs utilize photo-imageable barrier material to fabricate various shapes and forms to reduce feature sizes. Several of these designs utilize secondary barrier material of height less than barrier materials used to fabricate ink feed channels and firing chamber walls. Another variation describes creation of a filter mesh from two layers of reduced height barrier materials.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1:
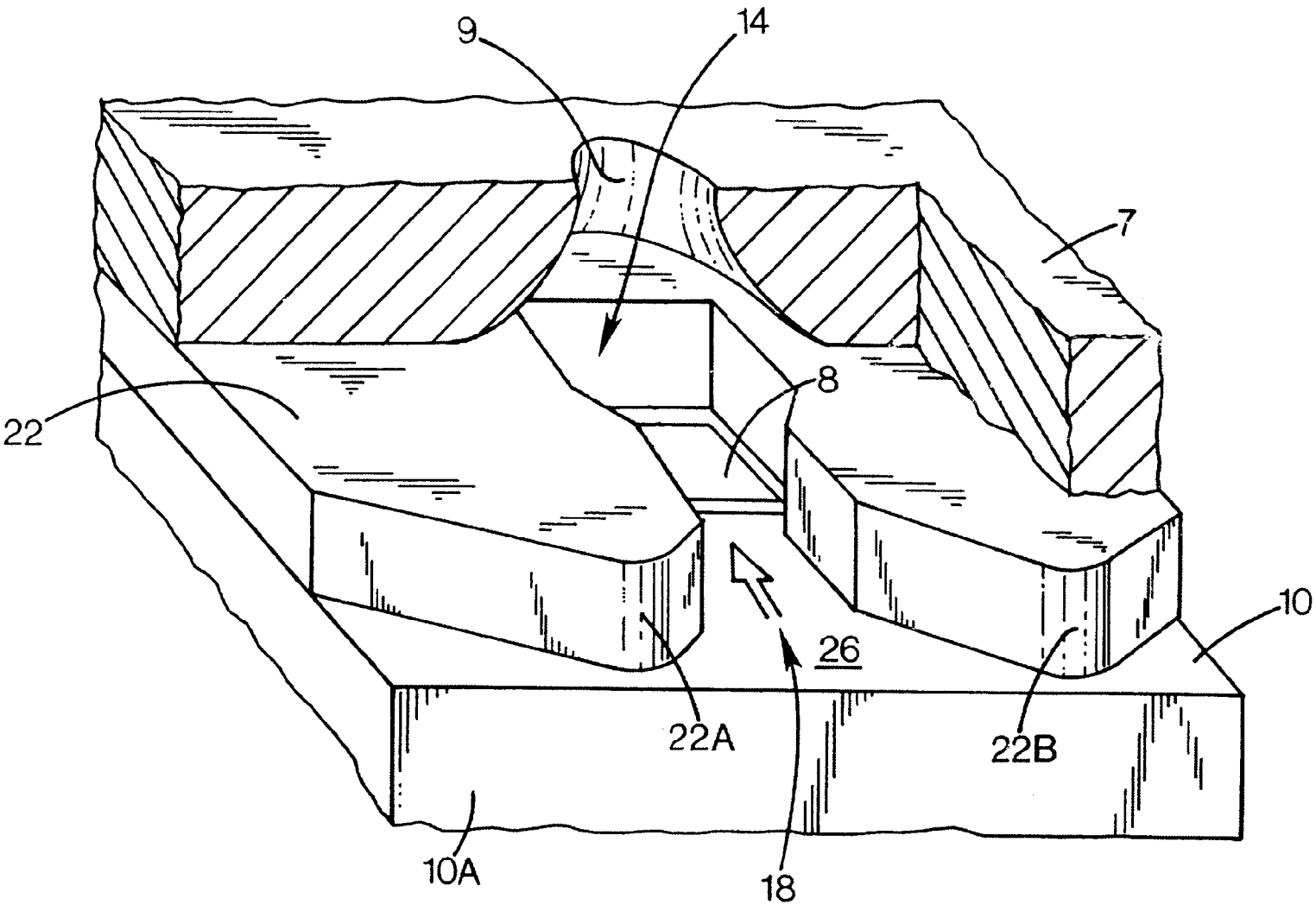
FIG. 1 illustrates a typical inkjet drop generator structure.

A magnified view of a portion of a typical thermal inkjet printhead for use in an inkjet printer is diagrammatically depicted in FIG. 1. The printhead includes a plurality of ink drop generators, each including a firing resistor, a firing chamber and a nozzle or orifice. Several elements of the printhead have been sectioned to reveal the silicon substrate 10, with a typical ink feed channel 26, firing chamber 14, and orifice 9 comprising a typical ink drop generator. Many such firing chambers are arranged in a group around an ink supply plenum for efficient refill of the firing chambers. Thus, associated with each firing chamber 14 is an orifice 9 formed in an orifice plate 7 disposed relative to the firing chamber 14 so that ink which is rapidly heated in the firing chamber by a heater resistor 8 is expelled as a droplet from the orifice 9. Ink is supplied to the firing chambers through an opening 26 called an ink feed channel. Ink is supplied to the ink feed channel from a much larger ink reservoir (not shown) by way of an ink plenum 18 which is common to all firing chambers in a group. For example, ink may be fed through a slot in the substrate or around the substrate side or edge, with substrate edge 10A (FIG. 1) defining an edge of the substrate. A slot fabricated in the substrate can also provide an ink plenum, and is illustrated in commonly assigned U.S. Pat. No. 5,463,413, in FIG. 2 as ink feed channel 18, with ink flowing from a reservoir located beneath the substrate and through the slot to the entrance to the ink flow channels.

Once ink is in the firing chamber 14, it remains there until it is rapidly heated to boiling by the heater resistor 8 and expelled out the orifice 9. Conventionally, the heater resistor is a thin film resistance structure disposed on the surface of the silicon substrate 10 and connected to electronic circuitry of the printer by way of conductors disposed on the substrate. The ink firing chamber 14 is bounded on the bottom side by the silicon substrate 10 with heater resistor 8 covered by passivation and/or barrier layers, and on the top side by the orifice plate 7 with its attendant orifice 9. The sides of the firing chamber and ink feed channels are defined by a barrier layer 22. This barrier layer is preferably made of a photoimagable material which is substantially inert to the corrosive action of the ink. Exemplary materials include Dupont PARAD (TM), Dupont VACREL (TM), acrylic dry film photoresists and liquid photoimagable polyimide. Barrier geometry is conventionally imaged by photolithographic processes and developed to produce barrier patterns desired. Alternatively, the separate barrier structure and orifice plate can be replaced by a unitary barrier/orifice structure, e.g. as described in U.S. Pat. No. 6,162,589.

While FIG. 1 illustrates a thermal inkjet drop generator, it will be understood that this invention is not limited to thermal inkjet structures, but generally has utility with all inkjet systems, including piezoelectric and the like.

Figure 2:
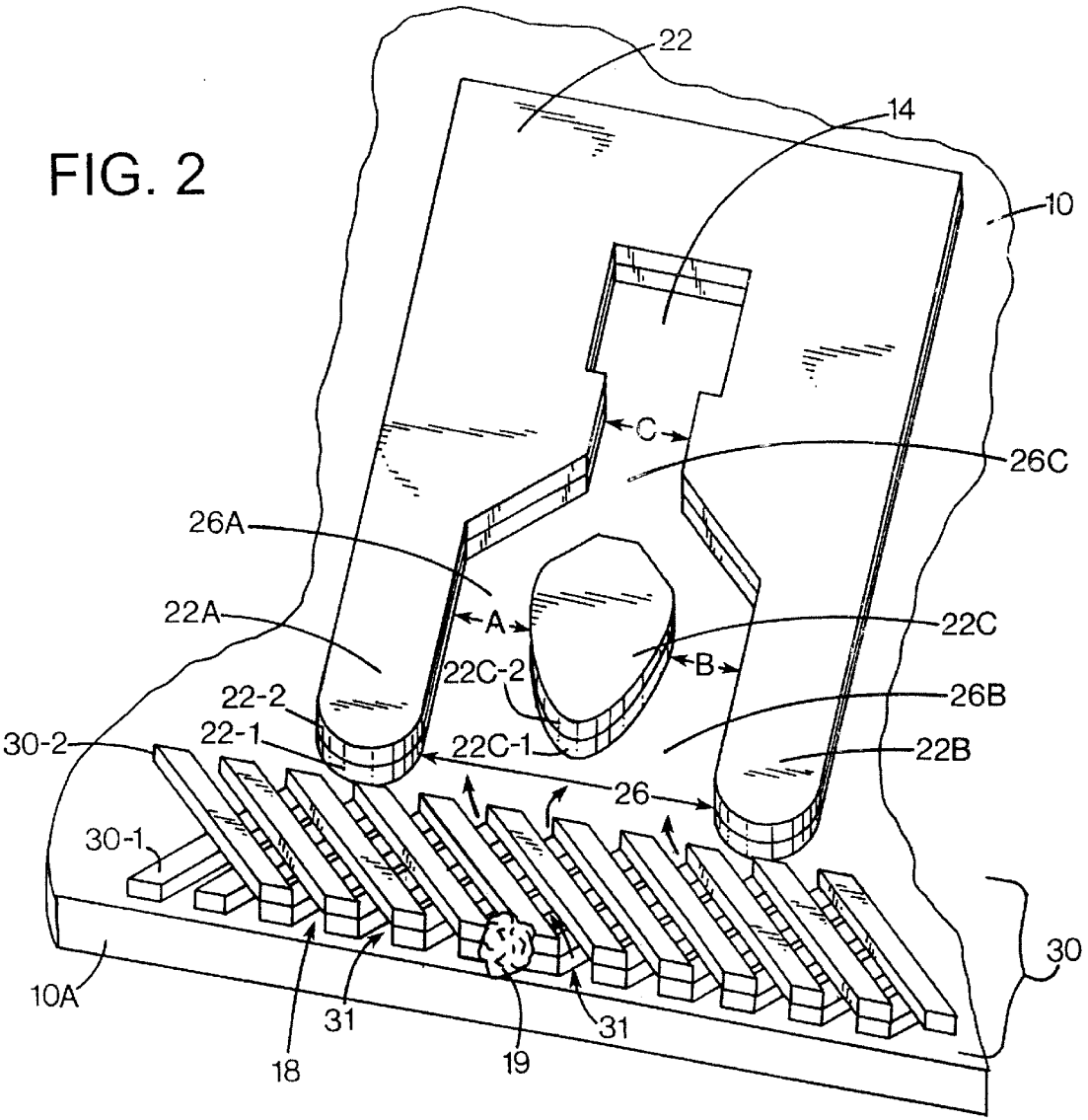
FIG. 2 diagrammatically illustrates a barrier lattice structure or filter mesh formed on a printhead substrate surface with photo-imageable barrier material.

FIG. 2 diagrammatically illustrates a first aspect of the invention, wherein a barrier lattice structure 30 is formed on a printhead substrate surface 10 outside the entrance to the ink feed channel 26 and firing chamber 14. Barrier features 22, 22A–22B and the barrier island 22C define the sides of ink feed channels 26A, 26B, 26C and the firing chamber 14 of the drop generator, with the ink feed channels covered by the orifice plate (not shown) and the base of the ink feed channels being the substrate surface 10.

In accordance with the first aspect of this invention, the barrier lattice structure 30 is incorporated into the printhead to entrap particles. The printhead has a smallest system fluidic dimension, likely to be either the nozzle orifice size or diameter or a width of the passageway connecting the ink supply plenum to the firing chamber. In FIG. 2, for example, the smallest width of the passageway is a dimension A, i.e. the width of flow channel 26A, a dimension B, the width of flow channel 26B or C, the reduced width of the flow channel 26C. The lattice filter structure defines openings or interstices 31 which are smaller than the smallest system fluidic dimension. Of course for some applications, the barrier island structure 22C may be omitted from the feed channel 26. Particles smaller in dimension than the smallest system fluidic dimension are able to pass through the lattice filter structure, and are then expelled out of the orifice during normal firing. Therefore, sizing the lattice structure openings smaller than the smallest system fluidic dimension will ensure larger particles (e.g. particle 19) are entrapped outside the critical ink feed channels or firing chambers, enabling proper firing of the inkjet drops.

In an exemplary embodiment, a barrier lattice is fabricated by two successive barrier application processes, each a 10 $\mu$m thick barrier layer in this exemplary embodiment. The first barrier layer 22-1 is laid down and imaged with the lower half of the ink feed channels, firing chamber, the island 22C-1 and filter mesh grid (hash mark pattern) 30-1. The second barrier layer 22-2 is laid down on top of the first and imaged with the upper half of the inkfeed channels, firing chamber, and upper half 30-2 of the lattice hash mark pattern to complete the filter mesh pattern. The lattice layers are aligned at offset angles to create multiple pathways through the interstices 31 of the lattice structure for ink to flow into the entrance of the ink feed channel 26. The cross section open area of ink flow channels through the lattice structure is optimized for a specific printhead design by the size of the lattice elements (height, width, angle) to balance the ink refill speed into the firing chamber with the tendency of ink to flow back into the reservoir during firing instead of out the orifice. In this embodiment, each opening 31 through the lattice is 10 $\mu$m high by 20 $\mu$m wide at the lattice entrance, and is associated with an orifice exit diameter of greater than 20 $\mu$m to prevent blockage from contaminants passing through the lattice filter structure.

Figure 3:
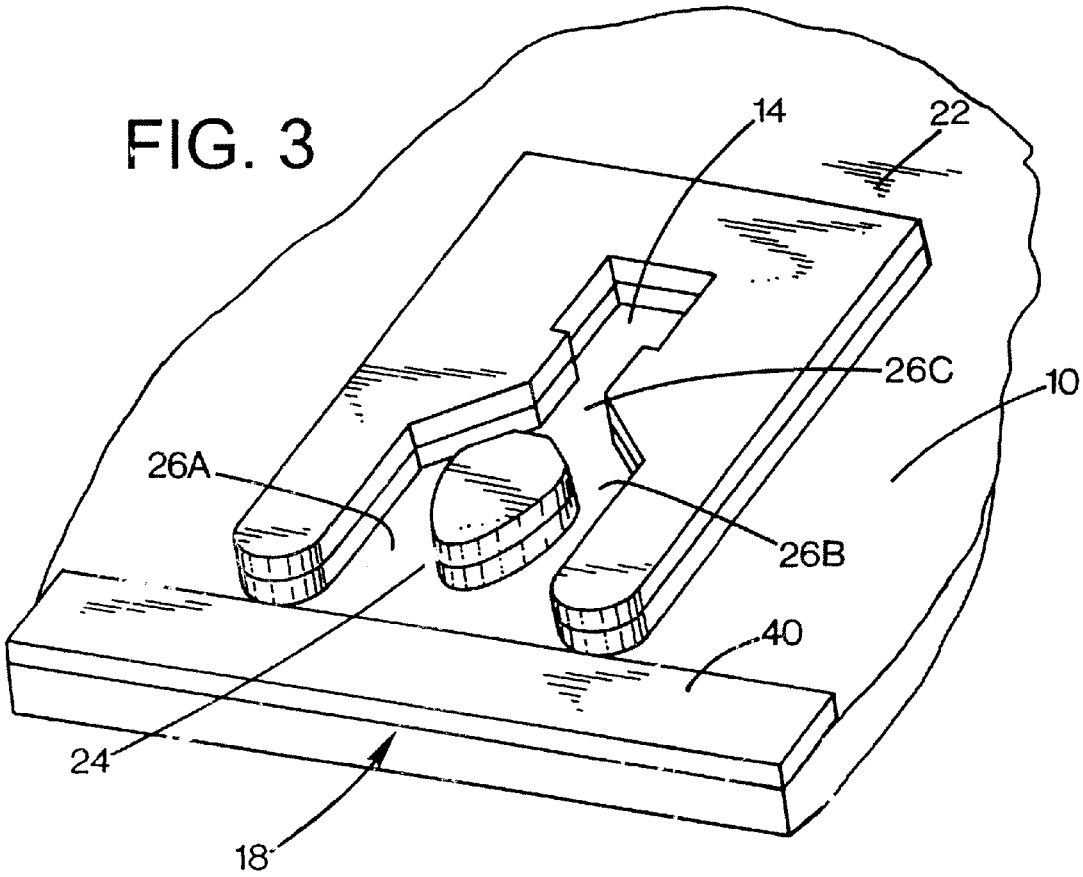
FIG. 3 illustrates another embodiment of a filtering technique in accordance with an aspect of this invention, employing a structure using barrier material of reduced height than the ink feed channels and firing chamber walls.

FIG. 3 illustrates another embodiment of a filtering technique in accordance with an aspect of this invention. In accordance with this aspect, a barrier ledge structure 40 of height less than the height of the barrier structure 22 defining ink feed channels 26A–26C, island 24 and firing chambers 14 is positioned across the path of the ink flow into the ink feed channels and firing chamber. The height of the opening between the top of the ledge and the underside of the orifice plate (not shown) is sized to enable particles of smaller dimensions to pass through the gap above the ledge and flow through the ink feed channels and firing chamber and be expelled out of the orifice during normal firing.

Figure 4:
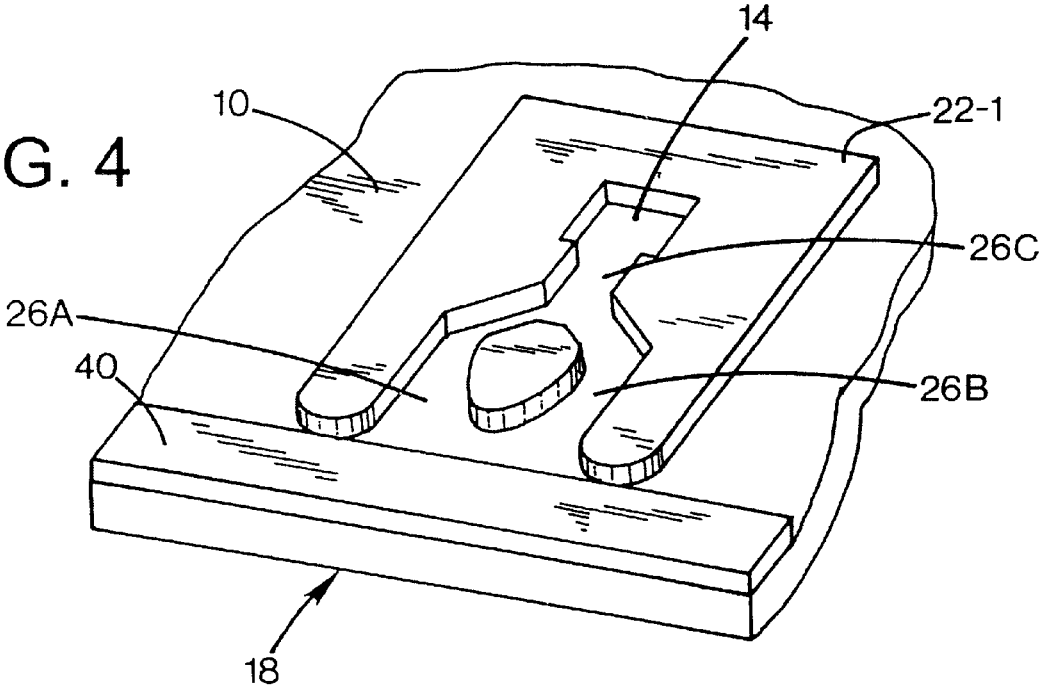
FIG. 4 illustrates an intermediate structure formed after a first barrier layer is formed, in fabrication of the embodiment of FIG. 3.

In an exemplary embodiment of this technique, a first barrier layer 22-1, 7 $\mu$m thick, is placed on top of the silicon substrate 10 and imaged with the pattern of the firing chamber 14, island 24, ink feed channels 26A–26C, and barrier ledge pattern 40 as in FIG. 4. A second barrier layer 22-2, 7 $\mu$m thick, is applied on top of the previous layer 22-1 and imaged with the upper half pattern of the firing chamber and ink feed channels. The unexposed material is then removed, leaving 14 $\mu$m high walls of barrier material around the firing chamber 14 and ink feed channels 26A–26C and a 7 $\mu$m high ledge 40 at the entrance to the ink feed channel 26, as shown in FIG. 3. Thus, the opening between the ledge 40 and the bottom of the orifice plate is 7 $\mu$m in this example, with a smallest system fluidic dimension greater than 7 $\mu$m. Thus, for this example, the nozzle diameter is greater than 7 $\mu$m.

While the barrier ledge structure 40 of FIG. 3 is formed in a continuous linear configuration across the silicon substrate, other configurations can alternatively be employed. For example, a structure can be defined as circular elements or other arbitrary shapes to reduce ink flow resistance during firing. The gaps between the elements are sized as the smallest fluidic system dimension so particles of smaller dimensions are able to pass through the ink channels 26A–26C and firing chamber passageways and be expelled out of the orifice during normal firing.

Figure 5:
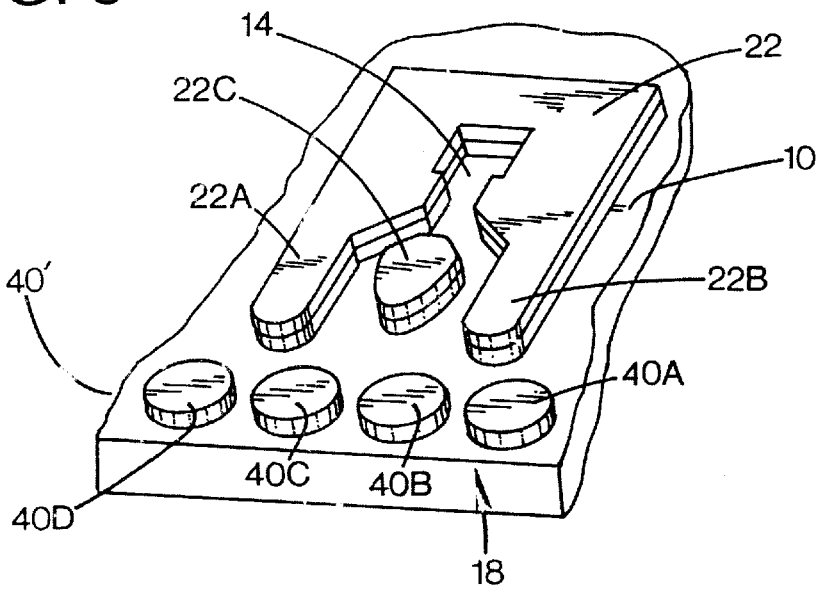
FIG. 5 illustrates diagrammatically a barrier structure comprising a series of barrier structures, separated by some distance smaller than the nozzle orifice diameter, and each of a reduced height relative to ink feed channels and firing chamber walls.

FIG. 5 illustrates a barrier ledge structure 40' comprising a series of circular barrier structures 40A–40D, separated by some distance smaller than the orifice diameter, and each of a reduced height relative to the ink feed channel and firing chamber barrier structure 20. In an exemplary embodiment, the barrier structures 40A–40D are created similarly to the ledge design of FIG. 3, with the circular structures imaged in the first layer of the barrier material with a height of 7 μm above the silicon substrate 10. The second barrier layer of photoimageable polyimide 7 μm thick, is applied on top of the previous layer and imaged with the upper half of the firing chamber and ink feed channels. The unexposed material is then removed leaving 14 μm high walls around the firing chamber and ink feed channels and 7 μm high circular structures at the entrance to the ink feed channel. The ledge structures 40A–40D are separated by a gap between circular islands 40A–40D of 7 μm to prevent particles larger than 7 μm wide by 14 μm high (cross section area) from passing through the gap and becoming lodged within the ink feed channels, firing chamber, or orifice, ultimately blocking ink flow.

Figure 6:
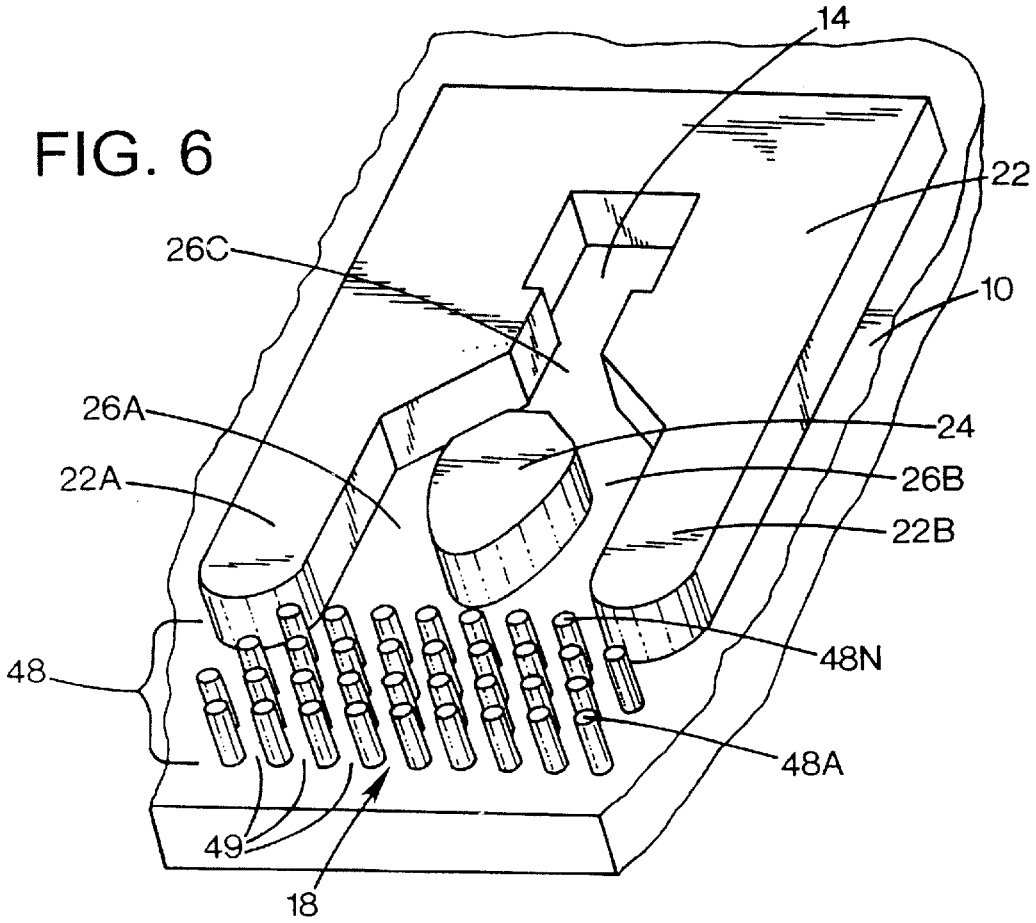
FIG. 6 illustrates another embodiment of a filtering technique in accordance with an aspect of this invention, employing superfluous barrier columns of reduced size, enabling loose or detached columns to be ejected through the orifice.

FIG. 6 illustrates another embodiment of a filtering technique in accordance with an aspect of this invention. In accordance with this aspect, superfluous barrier columns 48 are provided to reduce the gap spacing between columns 48 of ink passages 49 to the minimum fluidic system dimension so contamination particles of smaller dimensions able to pass through the filter structure can be expelled out of the orifice during normal firing of inkjet drops. These columns are sized in diameter so broken or loose columns 48A able to pass through the filter structure 48 are expelled out of the orifice during normal firing. Several rows of columns 48A–48N are fabricated to enable partial loss of columns during downstream assembly operations and still offer adequate filtration. Column heights extend from the silicon substrate 10 to the orifice plate.

In an exemplary embodiment, the ink feed channels and firing chambers are constructed out of 14 μm thick barrier material with the Kapton (TM) orifice plate covering the top surface and the silicon substrate covering the bottom surface. The nozzle exit orifice diameter is 15 μm. The associated superfluous columns are 14 μm tall and have 5 μm diameters. The ends of the columns attach to the orifice plate on top and substrate on the bottom similar to the ink feed channel and firing chamber construction.

Figure 7:
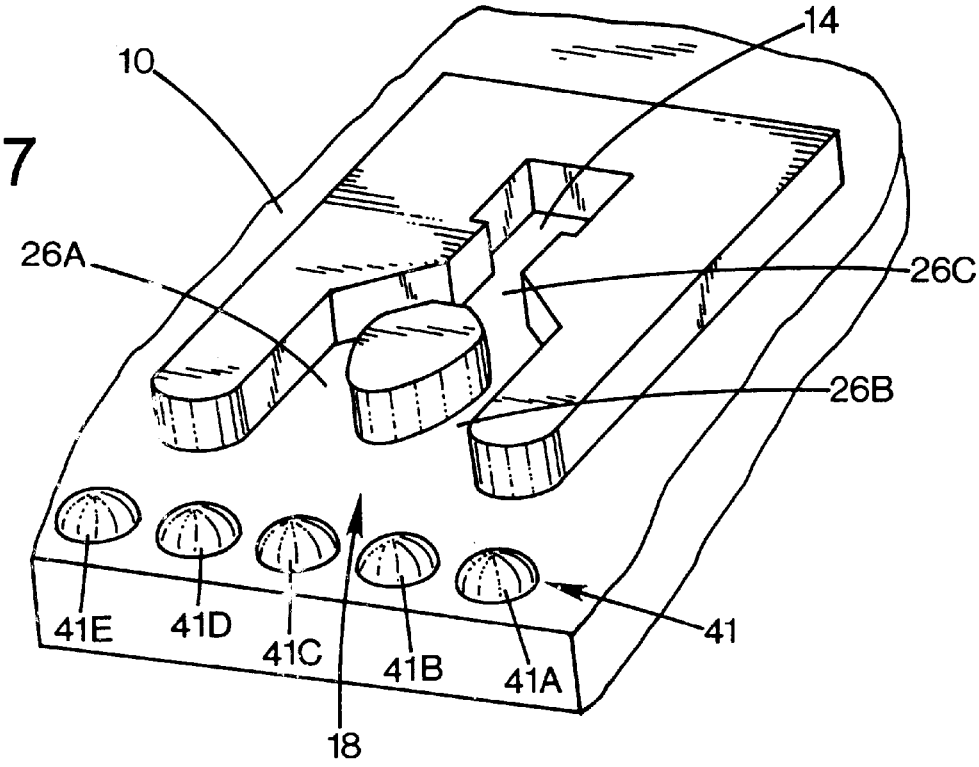
FIG. 7 illustrates another embodiment of a filtering technique in accordance with an aspect of this invention, employing a barrier bump structure, whereby barrier columns are created smaller in height than the ink feed channels and firing chamber walls using a different process than shown in FIG. 4.

FIG. 7 illustrates another embodiment of a filtering technique in accordance with an aspect of this invention. In accordance with this aspect, a barrier structure 41 comprises barrier bumps 41A–41E, that enables contamination particles to be trapped outside the sensitive ink feed channels 2GA–26C and firing chambers 14 by becoming lodged between the orifice plate, silicon substrate 10 and the barrier bumps. Contamination particles smaller than the minimum fluidic system dimension (orifice diameter or ink feed channels) will pass through the barrier bump structure 41 and be ejected out of the orifice during normal firing. Additionally, the barrier bumps 41A–41E can be sized (diameter/height) smaller than the minimum fluidic system dimension so that loose or broken off bumps will pass through the nozzle orifice during normal printing.

In an exemplary fabrication technique, the barrier bump structures 41A–41E, exposed during the photolithography processing, are reduced in exposure intensity by fabricating the reticle with sub-resolvable areas of masking to reduce the dosage during exposure, e.g. in a checkerboard mask pattern. In one exemplary embodiment, the ink feed channel 26 and firing chamber (14) walls are exposed with 20–40 milli-Joules/cm^2 light energy to fully crosslink the barrier material, whereas the barrier bump structures are exposed to 10–20 milli-Joules/cm^2 energy enabling the solvent wash to dissolve away the structures in a useable bump formation. This leaves a 14 μm thick barrier around the ink feed channels and firing chambers while the barrier bump structures are reduced in height to 7 μm. Tuning the shape for a particular application is done to ensure that the bump filter structure has filter opening sizes smaller than the smallest system fluidic dimension. The barrier bump structures can also be made of alternative geometries (height, width, wall slope, shape) to enable tuning of ink flow fluidic resistance through the barrier structure while keeping the particle entrapment benefits.

Figure 8:
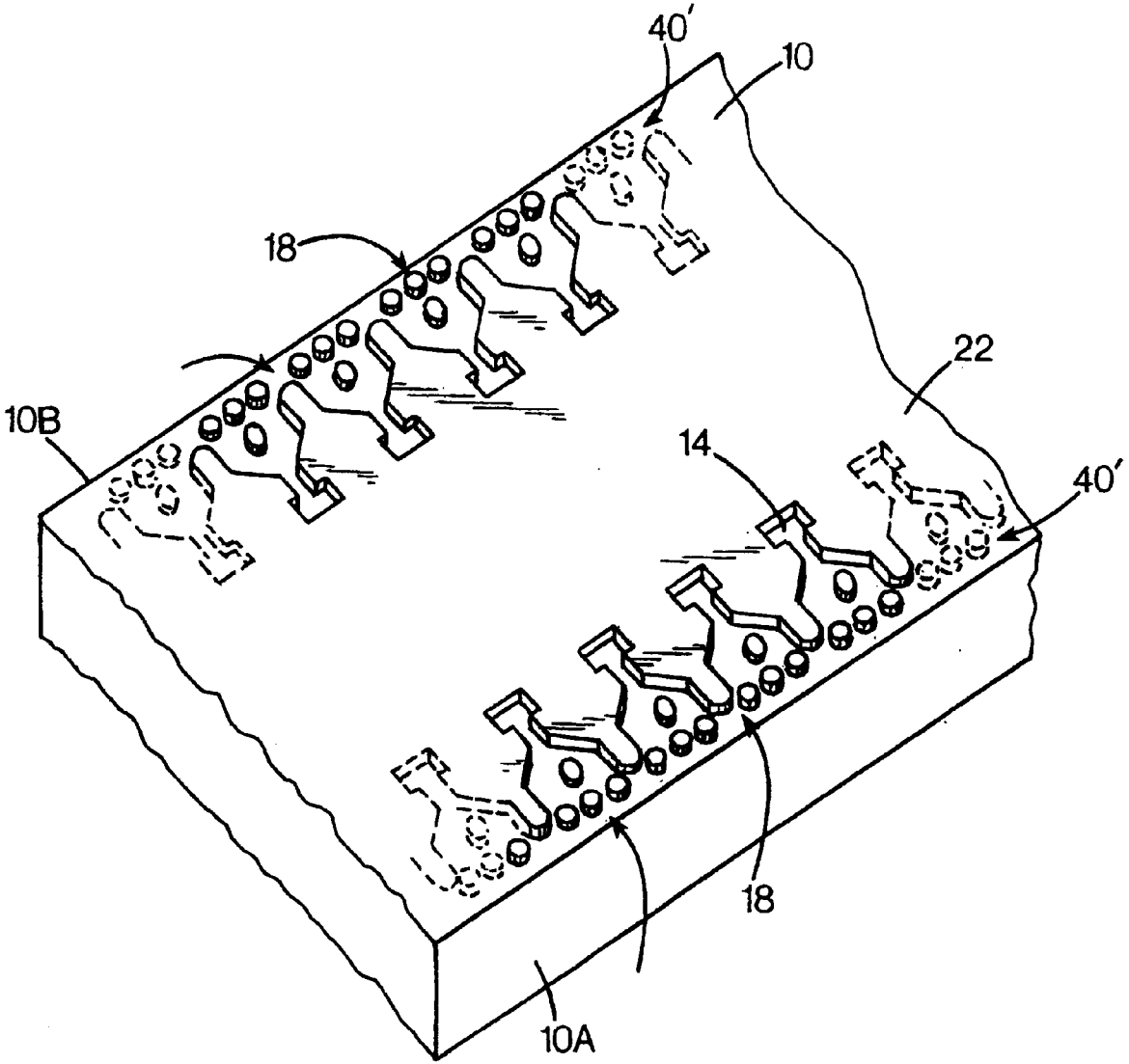
FIG. 8 is a diagrammatic view of a portion of a printhead showing a plurality of drop generators arranged along opposed longitudinal edges of the printhead substrate, with a filter structure along each substrate edge.

While FIGS. 1–7 illustrate a single drop generator structure on the printhead, it will be appreciated that a typical printhead includes many drop generators, e.g. 300 or even more. FIG. 8 diagrammatically depicts a portion of a printhead showing a first plurality of drop generators disposed along a first side edge 10A of the substrate 10 and a second plurality of drop generators disposed along a second opposed edge 10B of the substrate. Ink flows from the plenum 18 disposed below the substrate through the filter structure, here represented by exemplary bump structures 40' with spacings and height as described above regarding FIG. 5, into the ink feed channels to the firing chambers 14. The barrier layer 22 defines the feed channels, the firing chambers and the filter structure, as described above. The orifice plate is not shown in FIG. 8 for simplicity. The printhead could include, by way of example only, 150 drop generators on each side of the substrate.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printhead apparatus comprising:

an ink supply plenum;

a plurality of ink drop generators coupled to the ink supply plenum;

each ink drop generator including a nozzle orifice with a corresponding ink firing chamber, and an ink flow channel coupling the firing chamber to the ink supply plenum, the plurality of drop generators having a smallest system fluidic dimension;

a barrier layer structure defining said firing chamber and said ink flow channel;

a filter barrier structure positioned in a filter barrier zone between said ink firing chamber and said ink supply plenum and defining a filter opening having a size smaller than the smallest system fluldic dimension, said filter barrier structure having a filter barrier height less than a corresponding height of said barrier layer structure, said filter barrier structure fabricated of a photo-imageable material.

2. The printhead apparatus of claim 1, wherein said filter barrier layer includes a ledge of substantially uniform height extending across said filter barrier zone, and wherein a differential gap dimension between said uniform height and said corresponding height of said barrier layer structure is less than a diameter dimension of said orifice.

3. The printhead apparatus of claim 1, wherein said filter barrier structure comprises a plurality of bumps of said filter barrier height, said bumps having a spacing less than a diameter of said nozzle orifice.

4. The printhead apparatus of claim 1 wherein said photo-imageable material is a dry film photoresist or a liquid photoresist material.

5. The printhead apparatus of claim 1, wherein said barrier layer structure is fabricated of said photo-imageable material.

6. The printhead apparatus of claim 1, wherein said nozzle orifice is defined in an orifice plate fabricated on a top surface of said barrier structure.

7. The printhead apparatus of claim 1, wherein said smallest system fluldic dimension is the smaller of the following dimensions: a diameter of said nozzle orifice and a width of said ink flow channel.

8. The printhead apparatus of claim 1, wherein said filter barrier zone is disposed outside said ink flow channel.

9. The printhead apparatus of claims 1, wherein said filter structure comprises a plurality of post structures, each of reduced height relative to the corresponding height of said barrier layer structure.

10. The printhead apparatus of claim 9, wherein said plurality of post structures each has a circular cross-section.

11. A printhead apparatus comprising:

an ink supply plenum;

a plurality of ink drop generators coupled to the ink supply plenum, the plurality of drop generators having a smallest system fluidic dimension;

each ink drop generator including a nozzle orifice with a corresponding ink firing chamber and a heating resistor, and an ink flow channel coupling the firing chamber to the ink supply plenum, wherein selective energization of the heating resistor during printing operation causes ink drop ejection through the orifice;

a barrier layer structure defining said firing chamber and said ink flow channel;

a filter barrier structure positioned in a filter barrier zone between said ink firing chamber and said ink supply plenum and defining a filter opening having a size smaller than the smallest system fluidic dimension to entrap particles, said filter barrier structure having a filter barrier height less than a corresponding height of said barrier layer structure.

12. The printhead apparatus of claim 11, said filter barrier structure is fabricated of a photo-imageable material.

13. The printhead apparatus of claim 11, wherein said barrier layer structure is fabricated of said photo-imageable material.

14. The printhead apparatus of claim 11, wherein said nozzle orifice is defined in an orifice plate fabricated on a top surface of said barrier structure.

15. The printhead apparatus of claim 11, wherein said filter barrier layer includes a ledge of substantially uniform height extending across said filter barrier zone, and wherein a differential gap dimension between said uniform height and said corresponding height of said barrier layer structure is less than a diameter dimension of said orifice.

16. The printhead apparatus of claim 11, wherein said filter barrier structure comprises a plurality of bumps, said bumps having a spacing less than a diameter of said nozzle orifice.

17. The printhead apparatus of claim 11 wherein said photo-imageable material is a dry film photoresist or a liquid photoresist material.

18. The printhead apparatus of claim 11, wherein said barrier layer structure is fabricated of said photo-imageable material.

19. The printhead apparatus of claim 11, wherein said smallest system fluidic dimension is the smaller of the following dimensions: a diameter of said nozzle orifice and a width of said ink flow channel.

20. The printhead apparatus of claim 11, wherein said filter barrier zone is disposed outside said ink flow channel.

21. The printhead apparatus of claim 11, wherein said filter structure comprises a plurality of post structures, each of reduced height relative to the corresponding height of said barrier layer structure.

22. The printhead apparatus of claim 21, wherein said plurality of post structures each has a circular cross-section.

* * * * *